US008421379B2

(12) United States Patent
Yamamoto et al.

(10) Patent No.: US 8,421,379 B2
(45) Date of Patent: Apr. 16, 2013

(54) H-MODE DRIFT TUBE LINAC, AND METHOD OF ADJUSTING ELECTRIC FIELD DISTRIBUTION IN H-MODE DRIFT TUBE LINAC

(75) Inventors: Kazuo Yamamoto, Tokyo (JP); Hirofumi Tanaka, Tokyo (JP); Yoichi Kuroda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 320 days.

(21) Appl. No.: 12/790,195

(22) Filed: May 28, 2010

(65) Prior Publication Data

US 2010/0301782 A1 Dec. 2, 2010

(30) Foreign Application Priority Data

Jun. 1, 2009 (JP) ..... 2009-131711

(51) Int. Cl.
*H05H 9/00* (2006.01)

(52) U.S. Cl.
USPC ..... 315/505; 315/500; 250/214 VT; 250/396 R

(58) Field of Classification Search ..... 315/5, 5.34, 315/5.39, 5.43, 500–505, 3.6; 250/214 R, 250/214 VT, 207, 396 R; 313/359.1, 361.1
See application file for complete search history.

(56) References Cited

U.S. PATENT DOCUMENTS

| | | | | |
|---|---|---|---|---|
| 5,037,602 | A | 8/1991 | Dabiri et al. | |
| 6,493,424 | B2 * | 12/2002 | Whitham | 378/137 |
| 7,868,564 | B2 * | 1/2011 | Iwata et al. | 315/505 |
| 2004/0169554 | A1 * | 9/2004 | Langlois | 330/44 |
| 2005/0029970 | A1 * | 2/2005 | Ratzinger et al. | 315/500 |
| 2007/0085039 | A1 * | 4/2007 | Gorrell et al. | 250/494.1 |
| 2009/0261760 | A1 | 10/2009 | Iwata et al. | |

FOREIGN PATENT DOCUMENTS

| | | |
|---|---|---|
| JP | 61-225800 | 10/1986 |
| JP | 4-504174 | 7/1992 |
| JP | 4-315798 | 11/1992 |
| JP | 7-211495 | 8/1995 |
| JP | 11-67498 | 3/1999 |
| JP | 2002-324700 | 11/2002 |
| JP | 2003-32051 | 1/2003 |
| JP | 2006-351233 | 12/2006 |
| JP | 2007-87855 | 4/2007 |
| JP | 2007-157400 | 6/2007 |
| JP | 2009-9892 | 1/2009 |

OTHER PUBLICATIONS

Japanese Office Action issued Jan. 17, 2012 in patent application No. 2009-131711 with English translation.

(Continued)

*Primary Examiner* — Shawki Ismail
*Assistant Examiner* — Christopher Lo
(74) *Attorney, Agent, or Firm* — Oblon, Spivak, McClelland, Maier & Neustadt, L.L.P.

(57) ABSTRACT

An H-mode drift tube linac according to the present invention includes: an accelerator cavity which functions as a vacuum chamber and a resonator; drift tube electrodes for generating accelerating voltages in a charged particle transporting direction in the accelerator cavity; tuners for adjusting a distribution of electric fields generated at gaps between respective pairs of the drift tube electrodes; and antennas for measuring a variation of the distribution of the electric fields, the antennas being provided along the charged particle transporting direction in the accelerator cavity.

10 Claims, 11 Drawing Sheets

OTHER PUBLICATIONS
Japanese Office Action issued Mar. 27, 2012, in Japan Patent Application No. 2009-131711.
Office Action issued Apr. 12, 2011, in Japanese Patent Application No. 2009-131711.
Y. Iwata, et al., "Alternating-phase-focused IH-DTL for an injector of heavy-ion medical accelerators", Nuclear Instruments and Methods in Physics Research Section A, vol. 569, 2006, pp. 685-696.

* cited by examiner

H-MODE DRIFT TUBE LINAC, AND METHOD OF ADJUSTING ELECTRIC FIELD DISTRIBUTION IN H-MODE DRIFT TUBE LINAC

BACKGROUND OF THE INVENTION

1. Field of the Invention

The present invention relates to an H-mode drift tube linac which, by a TE-mode which excites a magnetic field in a charged particle transporting direction in an accelerator cavity, indirectly generates accelerating electric fields between a plurality of drift tube electrodes arrayed along a charged particle transporting direction, and accelerates charged particles, and to a method of adjusting an electric field distribution in the H-mode drift tube linac.

2. Description of the Background Art

An H-mode drift tube linac has two or more drift tube electrodes arrayed along the charged particle transporting direction (Z-axis direction) in an accelerator cavity which functions as a resonator to excite an H-mode, a gap being provided between each pair of the drift tube electrodes. The H-mode drift tube linac accelerates charged particles by indirectly generating an accelerating electric field in the gap between each pair of the drift tube electrodes.

The drift tube electrodes are hollow and have cylindrical shapes. Owing to an electric field generated at cylinder thickness parts of each pair (referred to as a cell) of the drift tube electrodes, accelerating energy is applied to charged particles, and then the accelerated particles pass through the inside of the drift tube electrodes. In this case, since in the accelerator cavity, a magnetic field is generated concentrically around the central axis of the accelerator cavity, an electric field distribution generated in the accelerator cavity owing to the magnetic field is, because of the H-mode, a sinusoidal distribution in which the intensity is minimum at the both ends of the accelerator cavity and is maximum at the middle thereof as viewed along the charged particle transporting direction (Z-axis direction).

The above electric field distribution in the accelerator cavity is in a state where the drift tube electrodes are not provided in the accelerator cavity. When the drift tube electrodes are provided in the accelerator cavity, since charged particles are yet to be accelerated and the velocities thereof are slower on the injection end side of the accelerator cavity than on the extraction end side thereof, the H-mode drift tube linac is designed such that the lengths of the drift tube electrodes are short on the injection end side. Therefore, since there are a relatively large number of the drift tube electrodes on the injection end side in the accelerator cavity, the electrostatic capacitance increases on the injection end side and the electric field distribution is such that the intensity is maximum at the injection end.

Such a concentration of the electric field distribution at the injection end side of the accelerator cavity causes, for example, a discharge between the drift tube electrodes, or heat generation in the accelerator cavity, resulting in hindering the linac from being stably used. Therefore, it is necessary to adjust the electric field distribution such that the maximum values of the electric field intensities at the gaps are uniform (flat) except at both the ends of the accelerator cavity, by, for example, optimally designing the inner diameter of the accelerator cavity, a tuner, or the like.

A radio-frequency phase at a time when charged particles arrive at the middles of the gaps is referred to as a synchronous phase, and charged particles are influenced so as to focus or defocus depending on a choice of the synchronous phase.

Here, the radio-frequency phase has a period of 180 degrees which is from −90 degrees to +90 degrees, and the electric field intensities are generated so as to have a cosine waveform.

It is known that, in the charged particle transporting direction (Z-axis direction), according to a principle of phase stability, charged particles are focused by choosing a negative phase (from −90 degrees to 0). This is because, since a negative synchronous phase is a region in which the electric field intensity increases with time, particles which have arrived at a gap are subjected to a stronger electric field intensity than preceding particles which have passed the gap, and catch up with the preceding particle, whereby charged particles are focused. Contrariwise, when a positive phase (from 0 to +90 degrees) is chosen, charged particles are defocused in the charged particle transporting direction.

On the other hand, in the radial direction perpendicular to the Z-axis direction, charged particles are focused by choosing a positive phase (from 0 to +90 degrees) from the shape of lines of electric force generated between each pair of the drift tube electrodes. This is because, since the shape of the lines of the electric force is a curved shape in which the lines are centrally directed in the radial direction in the front half of the gap, and are directed outward in the radial direction in the back half of the gap, charged particles are subjected to a stronger electric field intensity in the front half of the gap than in the back half of the gap owing to a positive synchronous phase, whereby charged particles are focused in the radial direction. Contrariwise, when a negative phase (from −90 degrees to 0) is chosen, charged particles are defocused.

As described above, when a positive phase is chosen, charged particles are defocused in the charged particle transporting direction, and contrariwise, focused in the radial direction. When a negative phase is chosen, charged particles are focused in the charged particle transporting direction, and contrariwise, defocused in the radial direction. Therefore, by varying the positive and negative sign of the synchronous phase with a cycle of several cells, charged particles can be focused both in the charged particle transporting direction and in the radial direction.

One example of such a self-focusing method is an APF (Alternating Phase Focused) method. An H-mode drift tube linac adopting the APF method uses the accelerating electric field not only for acceleration but also for focusing. Therefore, the fabrication tolerance for the design value of the electric field distribution (that is, fabrication accuracy of the accelerator cavity) becomes strictly.

Therefore, in conventional art, there are proposed, for example, an electric field distribution adjusting method (e.g., see Japanese Laid-Open Patent Publication No. 2007-157400) using a tuner, an electric field distribution adjusting method (e.g., see Japanese Laid-Open Patent Publication No. 2006-351233) based on the shapes of the drift tube electrodes, or a method (e.g., see Japanese Laid-Open Patent Publication No. 2007-87855) of adjusting only a resonance frequency so as not to vary the electric field distribution which has been once set.

Thus, in order to adjust the electric field distribution such that the maximum values of the electric field intensities at the gaps are uniform (flat) except at the both ends of the accelerator cavity, as a premise, it is necessary to measure, in advance, the distribution of the electric fields generated between the respective pairs of the drift tube electrodes in the accelerator cavity. As a method for such electric field distribution measurement, a perturbation method is known. In the perturbation method, a small measurement sphere is inserted along the charged particle acceleration axis in the accelerator cavity. Then, disturbance of the electric fields, generated at this time, slightly fluctuates energy accumulated in the accelerator cavity, and a resonance frequency varies along with the fluctuation. From the variation amount of the resonance frequency, the electric field intensity at a place where the measurement sphere is positioned is calculated.

Upon application of the perturbation method, a perturbation sphere is fixed to one end of a string to insert the perturbation sphere into the accelerator cavity, the other end of the string is connected to a motor placed outside the accelerator cavity, the perturbation sphere fixed to the string is inserted into the accelerator cavity by the motor driving (e.g., see Alternating-phase-focused IH-DTL for an injector of heavy-ion medical accelerators, Y. Iwata, et al., Nuclear Instruments and Methods in Physics Research Section A: Volume 569, 2006, Pages 685-696).

When the electric field distribution in the accelerator cavity is measured by adopting the above perturbation method, since it is necessary to insert the perturbation sphere from the outside of the accelerator cavity, the inside of the accelerator cavity should be at the atmospheric pressure. Therefore, the electric field distribution generated when the linac is actually operated after the inside of the accelerator cavity is vacuumized and a radio-frequency power is fed, cannot be measured at all.

Thus, for example, when there arises a problem that charged particles satisfying a specification are not extracted because the electric field distribution varies during operation owing to an heating variation or a thermal variation of the structure of the accelerator cavity, the following need and trouble arise conventionally. That is, there arises a need to, after all apparatuses connected to the front or the back of the accelerator cavity are removed and vacuum is released, measure again the electric field distribution in the accelerator cavity by the perturbation method, and confirm whether or not the electric field distribution between the drift tube electrodes in the accelerator cavity is generated in accordance with the designing, and thereby a trouble such as extra labor of measurement and confirmation, arises.

SUMMARY OF THE INVENTION

An object of the present invention is to solve the above problems, and to make it possible to, even during operation of an H-mode drift tube linac, observe in real time a variation of an electric field distribution generated in an accelerator cavity, thereby, for example, enabling early discovery of apparatus failure, and to easily adjust the electric field distribution, thereby reducing a trouble of adjustment.

An H-mode drift tube linac according to the present invention includes: an accelerator cavity which functions as a vacuum chamber and a resonator; drift tube electrodes for generating accelerating voltages in a charged particle transporting direction in the accelerator cavity; tuners for adjusting a distribution of electric fields generated at gaps between respective pairs of the drift tube electrodes; and antennas for measuring a variation of the distribution of the electric fields, the antennas being provided at least three positions which are a middle and both ends, along the charged particle transporting direction, of the accelerator cavity.

In addition, an H-mode drift tube linac according to the present invention includes: an accelerator cavity which functions as a vacuum chamber and a resonator; drift tube electrodes for generating accelerating voltages in a charged particle transporting direction in the accelerator cavity; tuners for adjusting a distribution of electric fields generated at gaps between respective pairs of the drift tube electrodes; and antennas for measuring a variation of the distribution of the electric fields, the number of the antennas being the same as that of the tuners, the antennas being provided along the charged particle transporting direction so as to correspond to respective positions at which the tuners are provided.

In addition, a method of adjusting a distribution of electric fields generated in an accelerator cavity in the H-mode drift tube linac according to the present invention, includes: a first step of: measuring the distribution of the electric fields, based on a perturbation method, when the H-mode drift tube linac is fabricated; and adjusting in advance the distribution of the electric fields by using the tuners, based on a result of the measurement such that, after the adjustment of the distribution of the electric fields, all outputs of the antennas tuned within a predetermined range; a second step of, after the first step, measuring outputs of the antennas during operation in which the inside of the accelerator cavity is vacuumized and the accelerating voltages are generated between respective pairs of the drift tube electrodes; and a third step of, when variation amounts of the measured values of the outputs of the antennas are equal to or larger than a set value, adjusting the tuners by varying insertion amounts of the tuners such that the variation amounts are smaller than the set value.

The present invention converts electromagnetic intensities based on measured values of antenna outputs, into a variation of an electric field distribution, and thereby makes it possible to, even during operation of an H-mode drift tube linac, observe in real time a variation of an electric field distribution. Thus, apparatus failure can be early detected and dealt with promptly. In addition, the electric field distribution can be easily adjusted, thereby enabling a trouble of adjustment to be reduced.

The foregoing and other objects, features, aspects and advantages of the present invention will become more apparent from the following detailed description of the present invention when read in conjunction with the accompanying drawings.

DETAILED DESCRIPTION OF THE PREFERRED EMBODIMENTS OF THE INVENTION

First Embodiment

Figure 1:
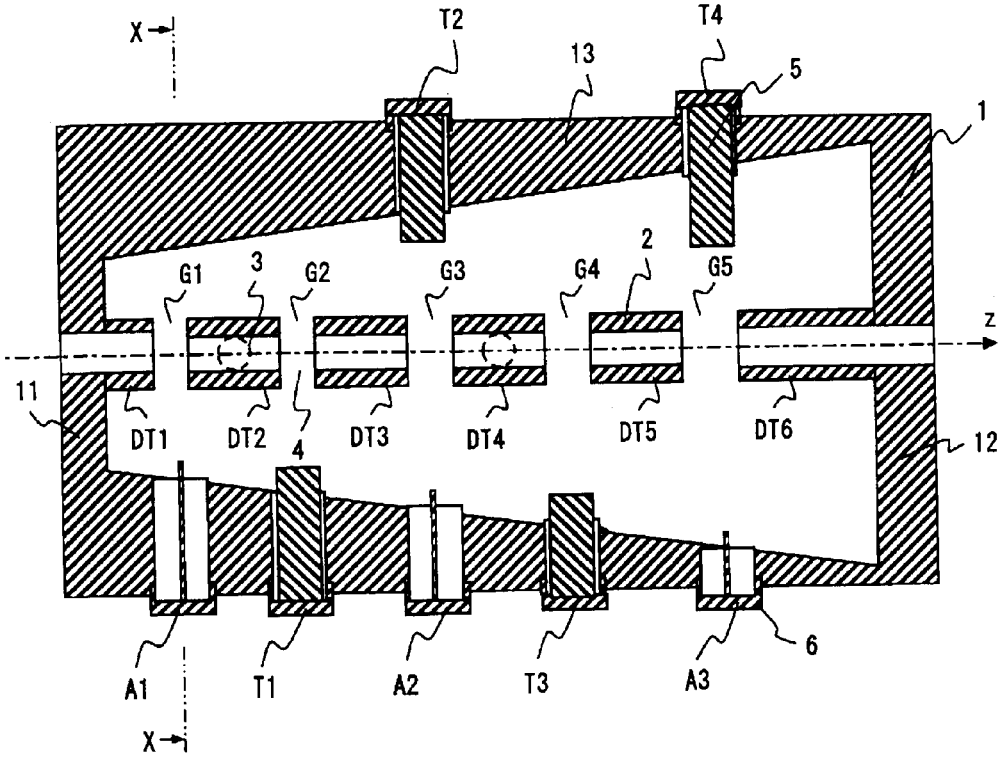
FIG. 1 is a cross-sectional view of an H-mode drift tube linac of a first embodiment of the present invention along the charged particle transporting direction (Z-axis direction)
Figure 2:
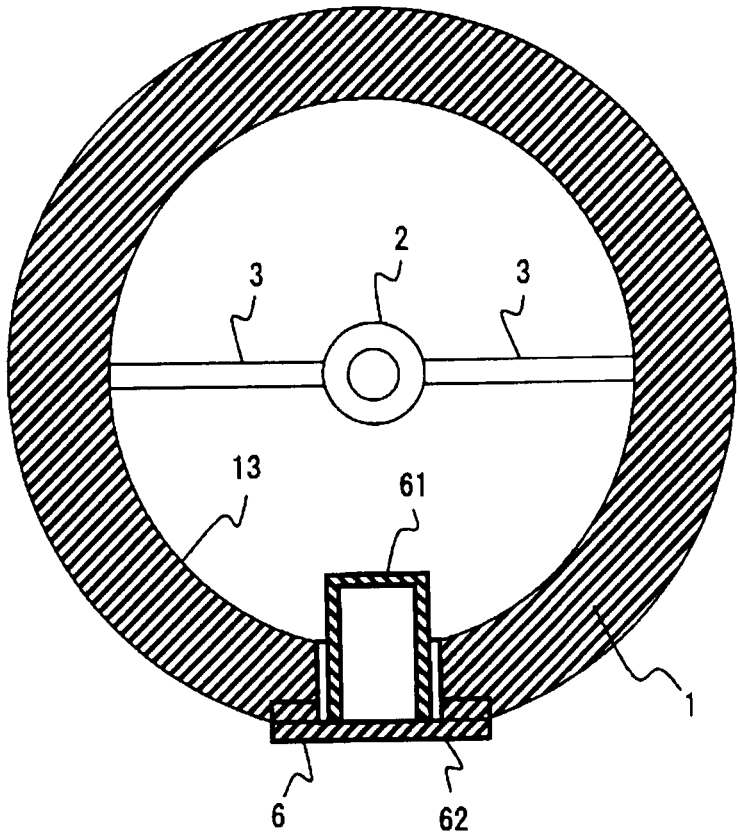
FIG. 2 is a cross-sectional view of the linac in FIG. 1 along an X-X line.

FIG. 1 is a cross-sectional view of an H-mode drift tube linac of a first embodiment along the charged particle transporting direction (Z-axis direction), and FIG. 2 is a cross-sectional view thereof along an X-X line perpendicular to the Z-axis direction.

The H-mode drift tube linac (hereinafter, simply referred to as a linac) of the first embodiment includes a hollow accelerator cavity 1 which functions as a vacuum chamber and a resonator. An injection end section 11 and an extraction end section 12 are respectively provided at the front and the back, in the charged particle transporting direction (Z-axis direction), of the accelerator cavity 1, the injection end section 11 and the extraction end section 12 having pass holes for charged particles. A trunk section 13 extends from the injection end section 11 to the extraction end section 12, and the inner circumferential surface of the trunk section 13 is formed as an inclined surface such that the diameter of the trunk section 13 is gradually expanded toward the extraction end section 12.

In a space inside the accelerator cavity 1, a plurality of (in the present embodiment, six) drift tube electrodes 2 are sequentially placed along the Z-axis direction, a predetermined gap 4 being present between each pair of the drift tube electrodes 2. Note that for the purpose of facilitating the understanding of the present invention, reference characters DT1 to DT6 are used when the drift tube electrodes 2 need to be discriminated from each other, and reference characters G1 to G5 are used when the gaps 4 need to be discriminated from each other.

Here, since charged particles increase in velocity as the charged particles approach the extraction end section 12, the lengths of the drift tube electrodes 2 are set so as to be gradually longer from the injection end section 11 to the extraction end section 12. In addition, the lengths of the gaps 4 are also set so as to be gradually longer from the injection end section 11 to the extraction end section 12.

Each drift tube electrode 2 is supported in a cantilevered manner by a stem 3 protruding inward in the radial direction from the trunk section 13 of the accelerator cavity 1. In this case, the stems 3 supporting the respective drift tube electrodes 2 are alternately positioned on the right and the left along the Z-axis direction.

An accelerating electric field is formed in the Z-axis direction at the gap 4 between each pair of the drift tube electrodes facing each other. Charged particles are accelerated by the accelerating electric field, from the injection end section 11 of the accelerator cavity 1 toward the extraction end section 12.

A plurality of (here, four) tuners 5 for adjusting the electric field distribution, and a plurality of (here, three) L-type (inductance-type) loop antennas (hereinafter, simply referred to as antennas) 6 for measuring a variation of the electric field distribution, are provided to the trunk section 13 of the accelerator cavity 1, the tuners 5 and the antennas 6 protruding from the trunk section 13 inward in the space in the accelerator cavity 1. Note that for the purpose of facilitating the understanding of the present invention, reference characters T1 to T4 are used when the tuners 5 need to be discriminated from each other, and reference characters A1 to A3 are used when the antennas 6 need to be discriminated from each other.

The tuners 5 are alternately provided at the upside and the downside of the trunk section 13 so as to be directed: toward the substantial middles of the second to fifth gaps 4 (G2 to G5) along the Z-axis direction; and in the directions which are turned by 90 degrees from the directions of the stems 3 supporting the drift tube electrodes 2 and which are perpendicular to the Z-axis direction. Note that a manner of providing the tuners 5 is not necessarily limited to the above-described manner in which the tuners 5 are alternately provided at the upside and the downside of the trunk section 13 along the Z-axis direction. All the tuners 5 may be provided at only one of the upside and the downside, along the Z-axis direction of the accelerator cavity 1. Also, the number of the tuners 5 is not necessarily limited to four as in the first embodiment.

A deviation from the design value, of the resonance frequency of the accelerator cavity 1, and a deviation from the design value, of a voltage between each pair of the drift tube electrodes 2, can be caused by accuracy error upon fabrication of the accelerator cavity 1. These deviations are adjusted by varying the insertion amounts of the tuners 5 being inserted inward from the trunk section 13 along the direction perpendicular to the Z-axis direction.

The antennas 6 (A1 to A3) are provided at a single side (here, the downside) of the trunk section 13 so as to be directed, in the directions perpendicular to the Z-axis direction, toward the substantial middles of the first, third, and fifth gaps 4 (G1, G3, and G5) along the Z-axis direction. Note that a manner of providing the antennas 6 is not necessarily limited to the above-described manner. The antennas 6 may be alternately provided at the upside and the downside of the trunk section 13 along the Z-axis direction. Also, the number of the antennas 6 is not necessarily limited to three as in the first embodiment.

The antennas 6 includes loop sections 61 provided so as to protrude inward from the inner circumferential surface of the trunk section 13 of the accelerator cavity 1, and adjustment systems 62 for adjusting the attenuation factors such that the antennas 6 have a common antenna output (for example, 30 V), the adjustment system 62 being attached to the trunk section 13 of the accelerator cavity 1. In this case, adopted for the adjustment systems 62 is, for example, a configuration which allows an inner portion of the cross-sectional area, surrounded by the loop section 61 of the antenna 6, to be varied, or a configuration which allows a substantial cross-sectional area (loop area obtained by projecting the loop section onto a plane perpendicular to the Z-axis direction) of the loop section 61 to be varied by rotating the loop section 61.

Each of the antennas 6 is configured to measure a voltage induced in the loop owing to a temporal variation of the magnetic field passing through the loop section 61 in accordance with Faraday's law. A variation of the electric field distribution in the accelerator cavity 1 is measured from outputs of the antennas 6.

Next, the relationship between: the accelerating electric field generated between each pair of the drift tube electrodes 2; and the electromagnetic field intensity measured by each of the antennas 6, will be described.

When S denotes a cross-sectional area surrounded by the inner circumference of the accelerator cavity 1 as taken along a plane including the middle (that is, the middle of each cell) of the gap 4 between each pair of the drift tube electrodes 2, the plane being perpendicular to the Z-axis direction, and when E denotes the electric field intensity generated at the gap 4 (having a gap length of l), a relational expression indicated by the following expression (1) is established between these values.

$$\int_c E \cdot dl = -\int_s \dot{B}_{cavity} \cdot dS \tag{1}$$

Here, B-cavity is the magnetic flux density in the accelerator cavity 1, and a dot denotes a temporal differential. S denotes the cross-sectional area surrounded by the inner circumference of the accelerator cavity 1. In addition, the left-hand side of the expression (1) is a voltage generated at the gap 4 of each cell, and the right-hand side is a temporal variation of the magnetic field within the cross-sectional area of the accelerator cavity 1, corresponding to the cell.

Similarly, regarding the antenna 6, when A denotes the loop area of the loop section 61; V denotes a voltage to be measured; and B-loop denotes the magnetic field within the loop, a relational expression indicated by the following expression (2) is established among these values.

$$V = -\int_s \dot{B}_{loop} \cdot dA \tag{2}$$

The relationship indicated by the following expression (3) about an attenuation factor is established between: the magnetic field (accelerator cavity cross-sectional magnetic field intensity) within the cross-sectional area of the accelerator cavity 1; and the magnetic field (loop cross-sectional magnetic field intensity) within the loop. Therefore, a voltage V measured by the antenna 6 is determined by a voltage generated between each pair of the drift tube electrodes 2.

$$AF \approx 10 \times \log_{10}\left(\frac{LMFI}{ACMFI}\right) \tag{3}$$

Where

AF: Attenuation Factor

LMFI: Loop Cross-Sectional Magnetic Field Intensity

ACMFI: Accelerator Cavity Cross-Sectional Magnetic Field Intensity

Just after the linac is fabricated, if the tip of the antenna 6 is inserted deeply inward in the accelerator cavity 1 to measure a variation of the electric field distribution, the antenna 6 outputs a voltage which cannot be observed by a general measurement apparatus because of a strong magnetic field. As a measure for the above problem, it may be possible to measure the large level of output from the antenna 6 by attenuating the output with an attenuator or the like. However, deep insertion of the antenna 6 is not appropriate because the performance of the linac is deteriorated by an unnecessary electric capacitance being generated between the tip of the antenna 6 and an internal object such as the drift tube electrode 2 provided in the accelerator cavity 1. Therefore, the antennas 6 are provided such that the tips of thereof are positioned near the inner circumferential surface of the accelerator cavity 1, or in a port.

If the antenna 6 is thus provided, the relationship between the magnetic field within the loop and the magnetic field within the cross-sectional area of the accelerator cavity 1 is not necessarily equal to the relationship indicated by the above expression (3) about an attenuation factor. Therefore, in this state, it is difficult to accurately measure the electric field generated between each pair of the drift tube electrodes 2, based on measured values of the antennas 6.

Therefore, upon adjustment of the electric field distribution just after fabrication, it is necessary to, while adjusting the electric field distribution in advance by using the tuner 5, measure the electric field distribution by the perturbation method to confirm the state of the electric field distribution. Once the electric field distribution has been adjusted by the perturbation method, a variation of the electric field distribution caused thereafter can sufficiently be observed. Hereinafter, this respect will be described.

In the perturbation method, the position of a small perturbation sphere is controlled by a stepper motor or the like, and then the electric field intensity is calculated from a variation of the resonance frequency of the accelerator cavity 1, whereby the electric field distribution between the drift tube electrodes 2 can be measured in detail.

Figure 3:
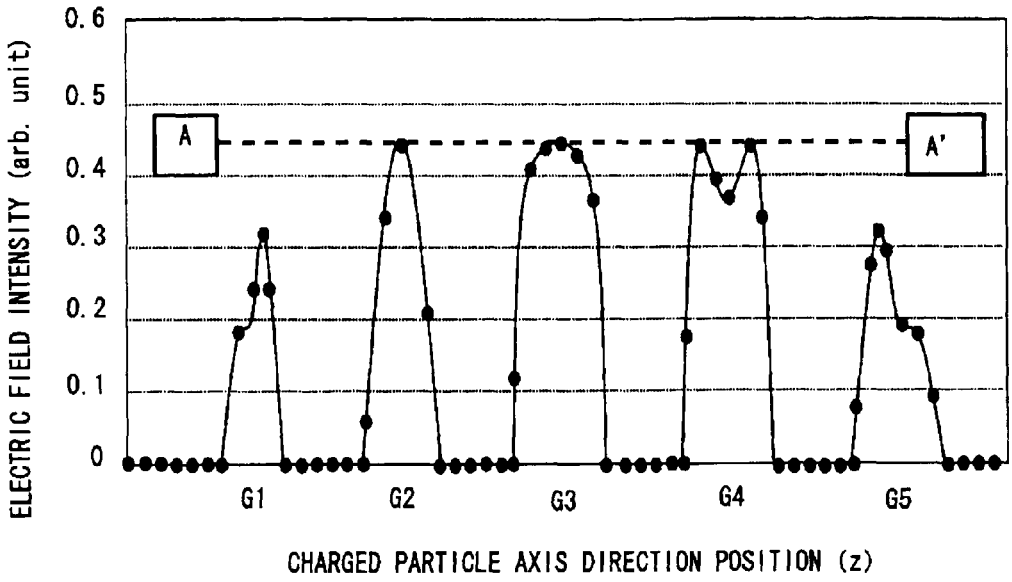
FIG. 3 shows an example of a result of measurement of the electric field distribution by a perturbation method.

FIG. 3 is an example of a result obtained by adjusting the electric field distribution by using the tuner 5 just after fabrication of the linac and then measuring the electric field distribution by the perturbation method. Note that in FIG. 3, a portion where the electric field is zero corresponds to the place where each drift tube electrode 2 is provided, and a portion where the electric field is generated mainly corresponds to each gap 4. However, since the electric fields also penetrate into the drift tube electrodes 2, a portion where a minute electric field is generated corresponds to end portions of each drift tube electrode 2.

In FIG. 3, a dashed line A-A' indicates a discharge limit electric field intensity. In general, the discharge limit is represented by a value several times (normally 1.6 to 1.8 times) as large as a Kilpatrick discharge limit, and is determined by the designer. In addition, it is known that the maximum electric field intensities at the gaps 4 (G1 and G5) near the respective end sections 11 and 12 of the accelerator cavity 1 are half as large as those at the other gaps 4 (G2 to G4). This is because the flows of the magnetic fields near the respective ends of the accelerator cavity 1 are different from those at the other portions owing to the presence of the end sections 11 and 12.

The electric field intensity contributes to discharge between each pair of the drift tube electrodes 2. The inner diameter of the accelerator cavity 1 is designed such that the maximum electric field intensities at the gaps 4 do not exceed the discharge limit, and that the maximum electric field intensities at the gaps 4 (G2 to G4) are uniform except at the gaps 4 (G1 and G5) near the respective end sections 11 and 12 of the accelerator cavity 1. In addition, the electric field distribution is adjusted by the tuner 5 after fabrication.

Figure 4:
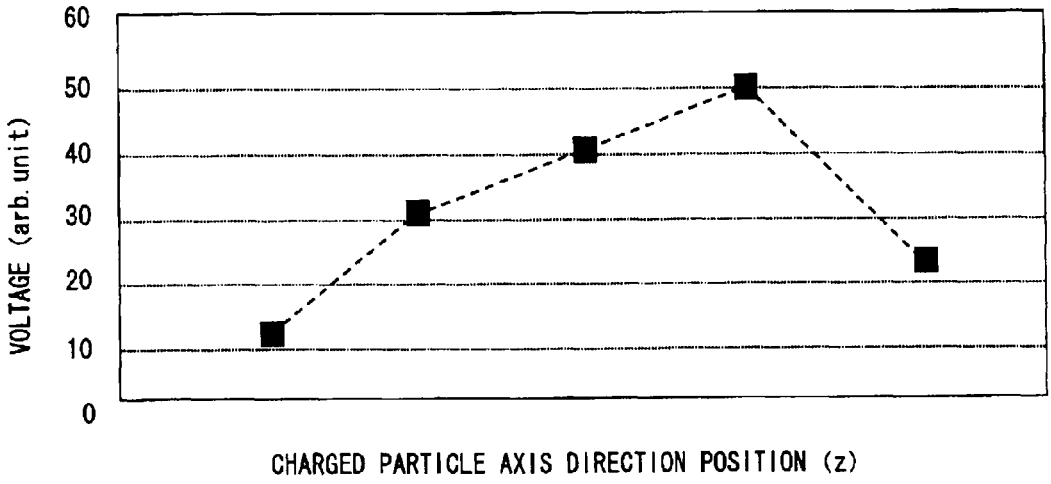
FIG. 4 shows an example of a voltage distribution calculated from the electric field distribution in FIG. 3.

FIG. 4 shows a voltage distribution (which corresponds to accelerating energy for charged particles) obtained from the electric field distribution shown in FIG. 3 by integrating the electric field intensity between each pair of the drift tube electrodes 2 with the corresponding gap length.

The lengths of the gaps 4 between the respective pairs of the drift tube electrodes 2 increase in proportion to the velocities of charged particles in order to efficiently accelerate the charged particles while preventing discharge between the drift tube electrodes, and thereby the maximum electric field intensities at the cells are set to be uniform except at the cells near the end sections 11 and 12 as shown in FIG. 3. Therefore, the voltage distribution becomes almost linear with respect to the Z-axis direction except at the first and last gaps 4 (G1 and G5) as shown in FIG. 4. Note that although the electric field distribution inclines at a certain rate in the first embodiment, the H-mode linac designed to have a uniform voltage distribution may be used.

The voltage design value can be obtained by calculating a voltage generated when power is fed upon actual operation. On the other hand, a voltage measured value based on the perturbation method is only obtained as a relative value, and only low power can be applied because of the convenience of the linac, e.g., because the linac cannot be vacuumized. Therefore, these values cannot be simply compared with each other.

Accordingly, as indicated by the following expression (4), these values are normalized by the summation of the voltages at the respective cells, and thereby the resultant values are compared.

$$\left.\begin{aligned} &\text{Design Value: } V_c^d \rightarrow V_c^d \Big/ \sum_{c=1}^{C_t} V_c^d \\ &\text{Measured Value: } V_c^m \rightarrow V_c^m \Big/ \sum_{c=1}^{C_t} V_c^m \end{aligned}\right\} \quad (4)$$

where $V_c^d$: Design Value of Voltage between Drift Tube Electrodes corresponding to Cell Number c $V_c^m$: Measured Value of Voltage between Drift Tube Electrodes corresponding to Cell Number c $C_t$: Total Cell Number A deviation corresponding to a cell number c is defined by an expression (5) with use of the design value and the measured value in the expression (4), thereby a deviation distribution can obtained.

$$\text{Deviation Distribution } \left[\frac{\Delta V}{V}\right]_c = \frac{V_c^m - V_c^d}{V_c^d} \times 100[\%] \quad (5)$$

The electric field distribution is adjusted upon fabrication by the tuners 5 such that all the deviations tuned within a predetermined range.

Figure 5:
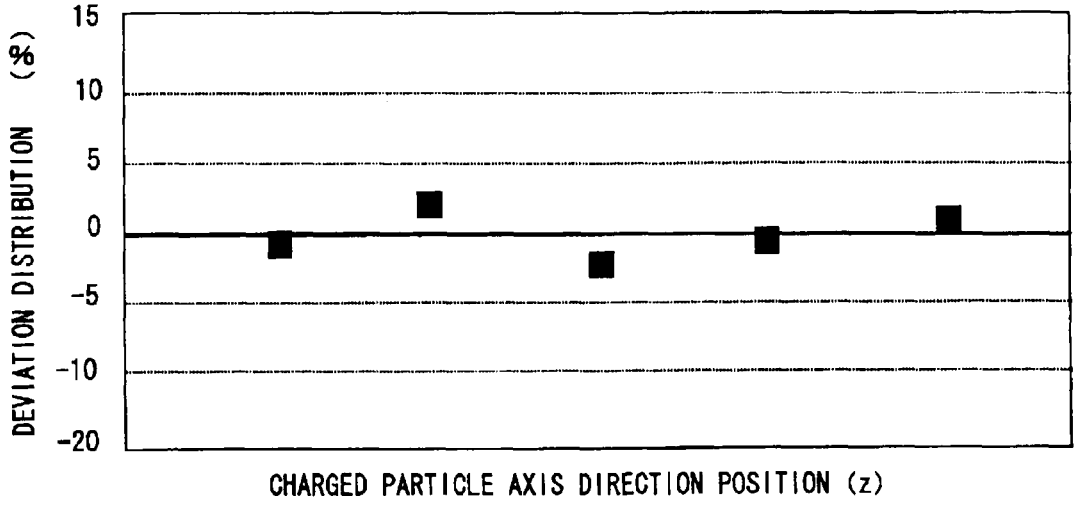
FIG. 5 shows an example of a deviation distribution of voltages, calculated from the voltage distribution in FIG. 4.

FIG. 5 shows a resultant deviation distribution obtained by adjusting the electric field distribution such that the deviations tuned within a specification range (±5%) by using the tuners 5. Note that the specification range of ±5% is a general range for the linac adopting the APF method to satisfy the specification.

Figure 6:
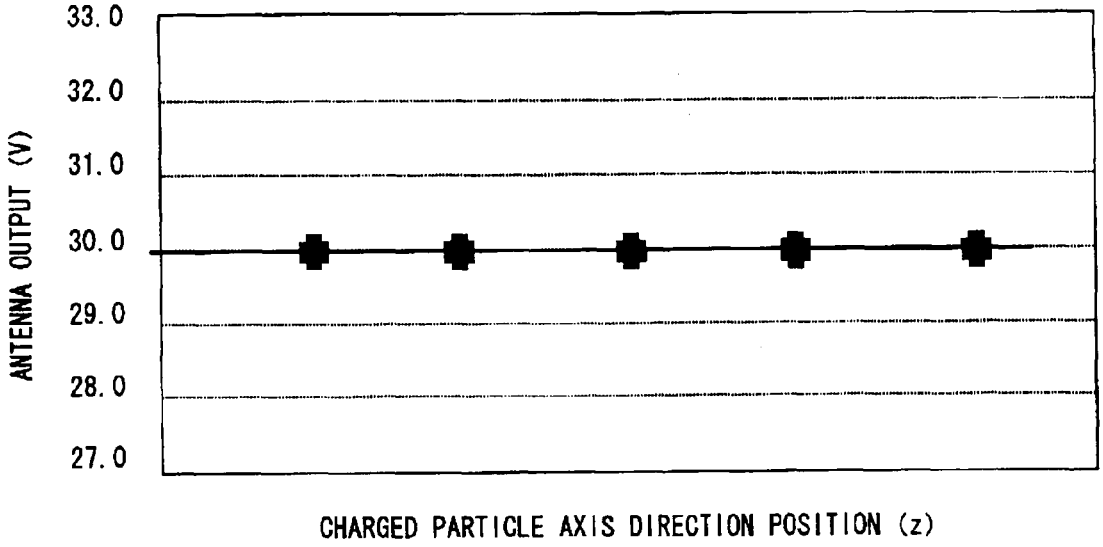
FIG. 6 shows an example of an antenna output distribution obtained when the outputs of antennas is adjusted after the electric field distribution is adjusted by tuners.

FIG. 6 shows resultant outputs of the antennas 6 obtained by, after the electric field distribution is adjusted by the tuner 5 to be substantially uniform as described above, adjusting the areas of the loop sections 61 by using the aforementioned antenna adjustment systems such that all the outputs of the antennas 6 are 30V.

Hereinbefore, a process of adjustment of the electric field distribution just after fabrication of the linac, that is, a process in which, after the electric field distribution is adjusted in advance the by the tuners 5, the electric field distribution is measured by the perturbation method to confirm the state of the distribution, is described.

After the electric field distribution of the linac is adjusted as described above, the inside of the accelerator cavity 1 is vacuumized for operation of accelerating charged particles, and then high power is fed. Here, if the electric field distribution is adjusted in advance as described above, a variation of the electric field distribution caused during the subsequent operation can sufficiently be observed based on outputs from the antennas in vacuum. Next, this respect will be described.

Factors causing a variation of the electric field distribution during operation of the linac are (1); a thermal variation in the accelerator cavity 1, (2); a variation of the insertion amount of each tuner 5, and (3); a variation of the gap length owing to a variation of the position where the drift tube electrode 2 is provided. The linac of the first embodiment is capable of early observing a variation of the electric field distribution owing to, particularly, (1) a thermal variation in the accelerator cavity 1 among the factors of (1) to (3).

That is, when high power is fed to the accelerator cavity 1 whose trunk section 13 varies in thickness along the Z-axis direction, because of, for example, defect in welding for providing an apparatus cooling pipe to the accelerator cavity 1, a portion on the injection end section 11 side or on the extraction end section 12 side, of the accelerator cavity 1, or even both the portions on the injection end section 11 side and the extraction end section 12 side, can expand (recurve) owing to heat generation of a tank.

The electric field distribution generated during operation in which high power is fed to the linac, cannot be measured by the perturbation method because the inside of the accelerator cavity 1 is kept vacuum. Therefore, here, the amount of a generated heat is calculated to estimate, from a thermal expansion coefficient, a variation of the cavity diameter of the accelerator cavity 1 caused when power is fed, and then the electric field distribution generated in the accelerator cavity 1 is calculated through simulation using three-dimensional electromagnetic field analysis. The results are shown in FIG. 7 and FIG. 8.

Figure 7:
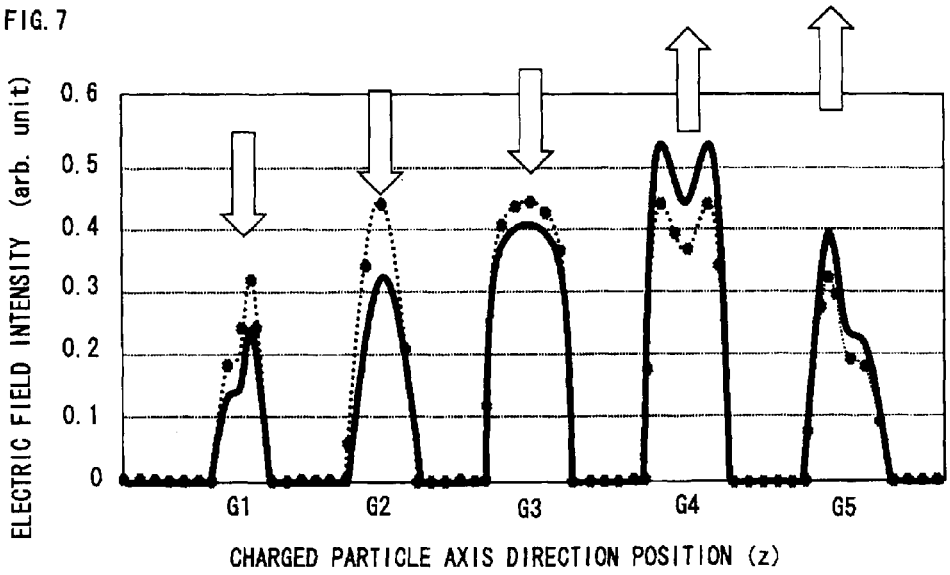
FIG. 7 shows an example of a calculated value of the electric field distribution generated in the case where the diameter of an inner circumferential wall on the extraction end section side, of the accelerator cavity, expands owing to thermal influence.
Figure 8:
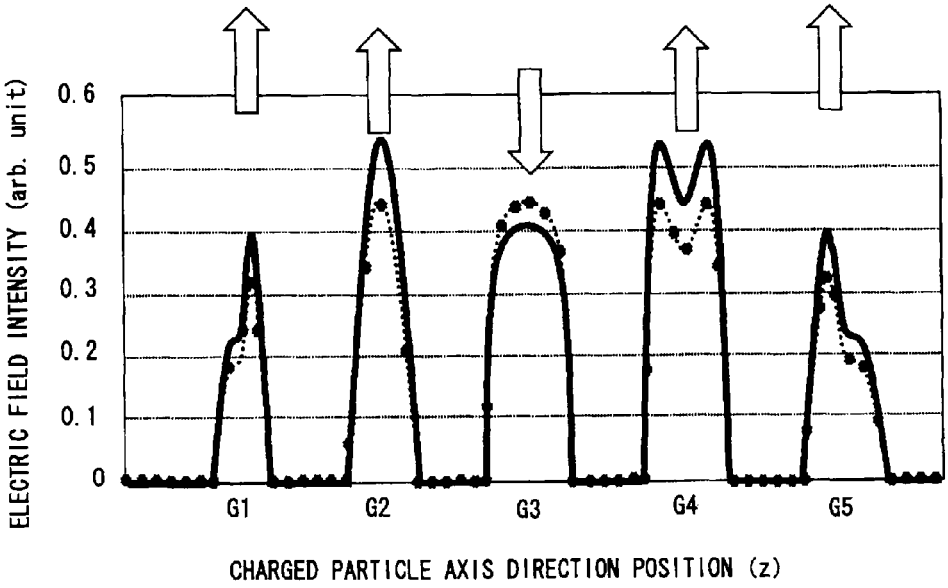
FIG. 8 shows an example of a calculated value of the electric field distribution generated in the case where both the diameters of the inner circumferential wall on the injection end section side and on the extraction end section side, of the accelerator cavity, expand owing to thermal influence.

FIG. 7 shows a calculation result obtained by simulating the electric field distribution generated in the case where only the cavity diameter on the extraction end section 12 side, of the accelerator cavity 1 has expanded. FIG. 8 shows a calculation result obtained by simulating the electric field distribution generated in the case where both the cavity diameters on the injection end section 11 side and on the extraction end section 12 side, of the accelerator cavity 1 have expanded.

When the inner diameter of a portion of the accelerator cavity 1 expands in a larger extend than those of the other portions, the magnetic field distribution generated in the accelerator cavity 1 varies, and the electric field intensity at the expanded portion increases as found from the expression (1). That is, when a portion on the extraction end section 12 side, of the accelerator cavity 1 has expanded, the electric field distribution on the extraction end section 12 side also increases along with the expansion of the accelerator cavity 1 (FIG. 7). Similarly, when a portion on the injection end section 11 side, of the accelerator cavity 1 has expanded, the electric field distribution on the injection end section 11 side also increases along with the expansion of the accelerator cavity 1. In addition, when both the portions on the injection end section 11 side and on the extraction end section 12 side, of the accelerator cavity 1 have expanded, the electric field distribution becomes a valley shape in which the electric fields at both the end sections 11 and 12 of the accelerator cavity 1 increases and the electric field at the middle of the accelerator cavity 1 relatively decreases (FIG. 8).

Figure 9:
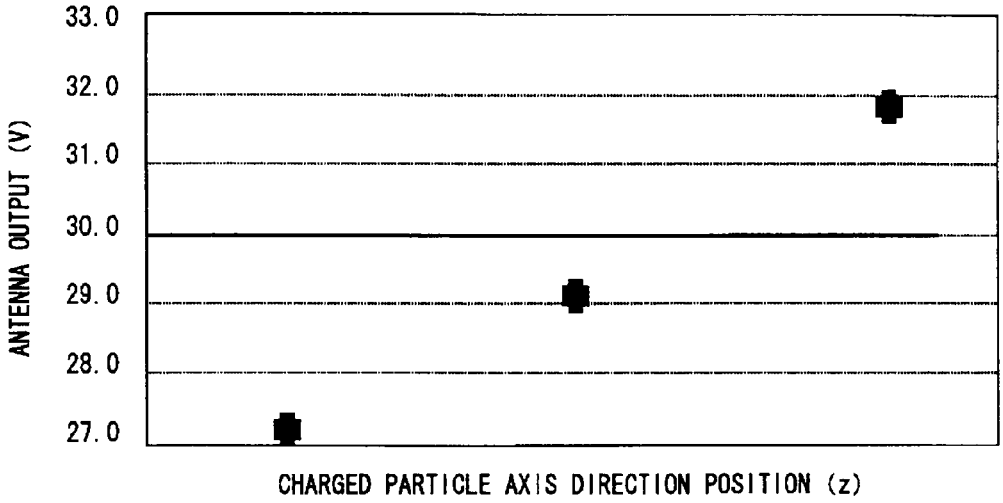
FIG. 9 is a diagram corresponding to FIG. 7, showing an antenna output distribution in the case where the diameter of the inner circumferential wall on the extraction end section side, of the accelerator cavity, expands.
Figure 10:
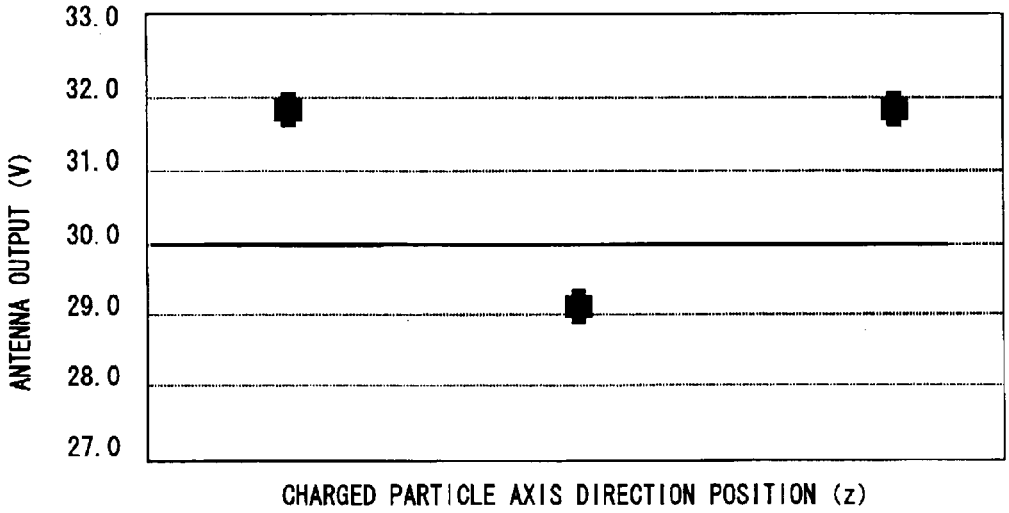
FIG. 10 is a diagram corresponding to FIG. 8, showing an antenna output distribution in the case where both the diameters of the inner circumferential wall on the injection end section side and on the extraction end section side, of the accelerator cavity, expand.

FIG. 9 and FIG. 10 show outputs of the antennas actually observed in the above cases. Note that FIG. 9 corresponds to the case (where only the cavity diameter on the extraction end section 12 side, of the accelerator cavity 1 has expanded) shown in FIG. 7, and FIG. 10 corresponds to the case (where both the cavity diameters on the injection end section 11 side and on the extraction end section 12 side, of the accelerator cavity 1 have expanded) shown in FIG. 8.

As found from the relationships between FIG. 7 and FIG. 9, and between FIG. 8 and FIG. 10, when the electric field distribution has varied owing to a thermal variation in the accelerator cavity 1 caused by high power being fed during operation of the linac, the feature of the variation of the electric field distribution is grasped in vacuum, by measuring the outputs of the three antennas 6 (A1 to A3) provided at the respective positions corresponding to the gap 4 (G3) at the middle of the accelerator cavity 1 and the gaps 4 (G1 and G5) near both the end sections 11 and 12. Thus, there is no need to, as in conventional art, remove all apparatuses connected to the front or the back of the accelerator cavity 1 and release the vacuum, and apparatus failure can be discovered early.

Moreover, when, for example, the outputs of the antennas as shown in FIG. 9 and FIG. 10 are obtained, the linac which constantly ensures stable operation can be obtained by automatically performing feedback control for adjusting the insertion amounts of the tuners 5 in accordance with the variation of the electric field distribution and for correcting the deviation from the design value. To achieve this, it is necessary to obtain, through calculation or measurement, how the insertion amounts, in the radial direction of the accelerator cavity 1, of the tuners 5 influence a voltage between each pair of the drift tube electrodes 2, and to store in advance, as a database, the relationships (hereinafter, referred to as tuner effect) between the insertion amounts of the tuners and variations of the voltages.

Accordingly, next, there will be described a method of obtaining, through analysis (calculation) of the electromagnetic field in the accelerator cavity 1 or measurement performed by actually using the fabricated accelerator cavity 1, the above tuner effect, that is, how the insertion amount, in the radial direction of the accelerator cavity 1, of each tuner 5 influences a voltage between each pair of the drift tube electrodes 2.

When the tuner 5 is inserted into the accelerator cavity 1, the magnetic field distribution in the accelerator cavity 1 varies, and as found from the expression (1), the electric field intensities (or voltages obtained by integrating the electric field intensities) vary such that the electric field intensity between the drift tube electrodes 2 near the inserted tuner 5 decreases, and that the electric field intensities between the other drift tube electrodes 2 increase.

Here, when the insertion amount of the tuner 5 is sufficiently small in comparison with the inner diameter of the accelerator cavity 11, variations of the voltages are almost in proportion to the insertion amounts of the tuners 5. In addition, a variation of the magnetic field in the accelerator cavity 1 is the summation of variations of the magnetic fields caused by the respective tuners 5. Therefore, a variation of the voltage between each pair of the drift tube electrodes 2 can be obtained by the summation of variations of the voltage caused by the respective tuners 5. Note that when the tuners 5 are extracted from the accelerator cavity 1, a manner contrary to the above is used.

By using the above relationships, how the insertion amount, in the radial direction of the accelerator cavity 1, of each of the tuners 5 (T1 to T4) influences the voltage between each pair of the drift tube electrodes 2, is obtained as a database through calculation or measurement, regarding each tuner 5 in one typical case. Thus, it becomes possible to calculate a voltage between each pair of the drift tube electrodes 2, which is to be generated when the individual insertion amounts of the tuners 5 are determined.

Figure 11:
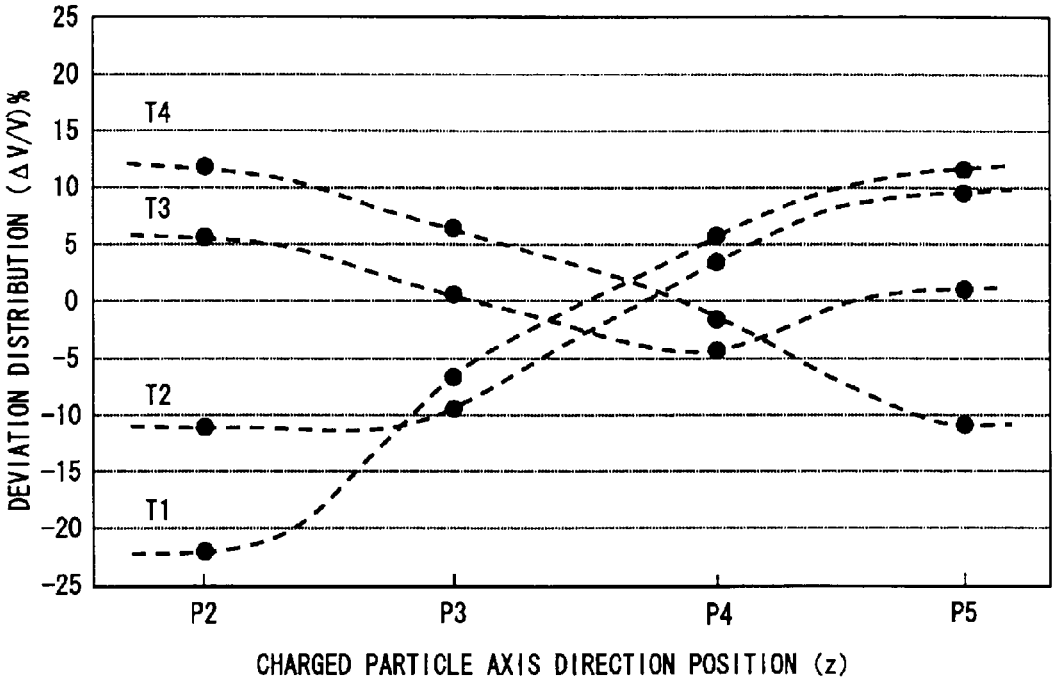
FIG. 11 shows a calculation value of a deviation distribution of a voltage between each pair of the drift tube electrodes in the case where each tuner is inserted by a predetermined amount from a reference position in the accelerator cavity.

FIG. 11 shows a deviation distribution [ΔV/V] (see the expression (5)) of voltages between the respective pairs of the drift tube electrodes 2, obtained through calculation in one typical case in accordance with the above-described concept. In the above typical case, a position at which each of the tuners 5 (T1 to T4) is inserted by d=30 mm from the inner circumferential surface of the accelerator cavity 1, is determined as a reference position, and the tuner 5 is further inserted by 20 mm from the reference position. Note that P1 to P4 on a horizontal axis in FIG. 11 correspond to the respective positions at which the tuners 5 are provided. Therefore, in FIG. 11, for example, when the tuner T1 (position P2) is inserted by 20 mm from the reference position, the deviation corresponding to the tuner T1 is −22%, the deviation corresponding to the tuner T2 is −11%, the deviation corresponding to the tuner T3 is 5%, and the deviation corresponding to the tuner T4 is 12%. Then, the relationship shown in FIG. 11 is made into a database of the tuner effect.

Next, similarly to a manner of obtaining a variation of a voltage between each pair of the drift tube electrodes 2, how the insertion amount, in the radial direction of the accelerator cavity 1, of each of the tuners 5 (T1 to T4) influences the resonance frequency is obtained through analysis (calculation) of the electromagnetic field in the accelerator cavity 1 or measurement performed by actually using the fabricated accelerator cavity 1.

The amount of a variation of the resonance frequency caused by each tuner 5 being inserted by 1 mm is shown in Table 1. Also here, when the insertion amount of the tuner 5 is small, the amount of the variation of the resonance frequency is in proportion to the insertion amount of the tuner 5, and the amount of the variation of the resonance frequency caused by all the tuners 5 being inserted is represented by the summation of variations of the resonance frequency caused by the respective tuners 5 being inserted.

| Tuner Number | T1 | T2 | T3 | T4 |
|---|---|---|---|---|
| Coefficient[kHz/mm] | 10.7 | 9.5 | 17.7 | 16.5 |

$$\text{Deviation Distribution}\ \left[\frac{\Delta V}{V}\right]_c = \left[\sum_{t=1}^{T} \Delta d_t\right]_c + \left[\frac{\Delta V_0}{V}\right]_c \tag{6}$$

Where, Δdt is a variation of a voltage caused when a tuner of a number t in the Z-axis direction is inserted, and $\Delta V_0/V$ is a variation of a voltage intensity owing to a thermal variation in the accelerator cavity 1.

In the expression (6), the first term of the right-hand side represents an influence of the insertion amount of each tuner 5 on a variation of a voltage between each pair of the drift tube electrodes, and the second term of the right-hand side represents an influence in the case where only a thermal variation has occurred in the accelerator cavity 1 without changing the insertion amount of the tuner 5.

Then, the insertion amounts of all the tuner 5 are determined such that the deviation distribution and the resonance frequency tuned within a range of the specification values. That is, in the expression (6), calculation is performed such that: an influence of the thermal variation of the body of the accelerator cavity 1 is reflected in the determination of the insertion amounts by replacing the second term of the right-hand side of the expression (6) by the deviation distribution obtained from the output signals of the antennas 6; and that the first term of the right-hand side of the expression (6) uses a value obtained by exhaustively combining the insertion amounts ($\Delta d1$, $\Delta d2$, . . . , $\Delta dt$) of the tuners 5. Through such calculation, a combination of the insertion amounts of the tuners 5, which causes the deviation distribution of the left-hand side to tuned within a range (±5%) of specification values, is figured out. Thus, feedback control of the insertion amounts of the tuners 5 can be realized.

According to the above, for example, in the case where a variation in FIG. 9 is caused, if the insertion amounts of the tuners 5 (T1 to T4) are ($\Delta d1$, $\Delta d2$, $\Delta d3$, $\Delta d4$)=(−1.9 mm, 21.4 mm, 6.4 mm, 20.6 mm), the deviation distribution of the left-hand side of the expression (6) tuned within a range (±5%) of specification values. In addition, in the case where a variation in FIG. 10 is caused, if the insertion amounts of the tuners 5 (T1 to T4) are ($\Delta d1$, $\Delta d2$, $\Delta d3$, $\Delta d4$)=(6.5 mm, 18.1 mm, 7.9 mm, 15.4 mm), the deviation distribution of the left-hand side of the expression (6) tuned within a range (±5%) of specification values.

Figure 12:
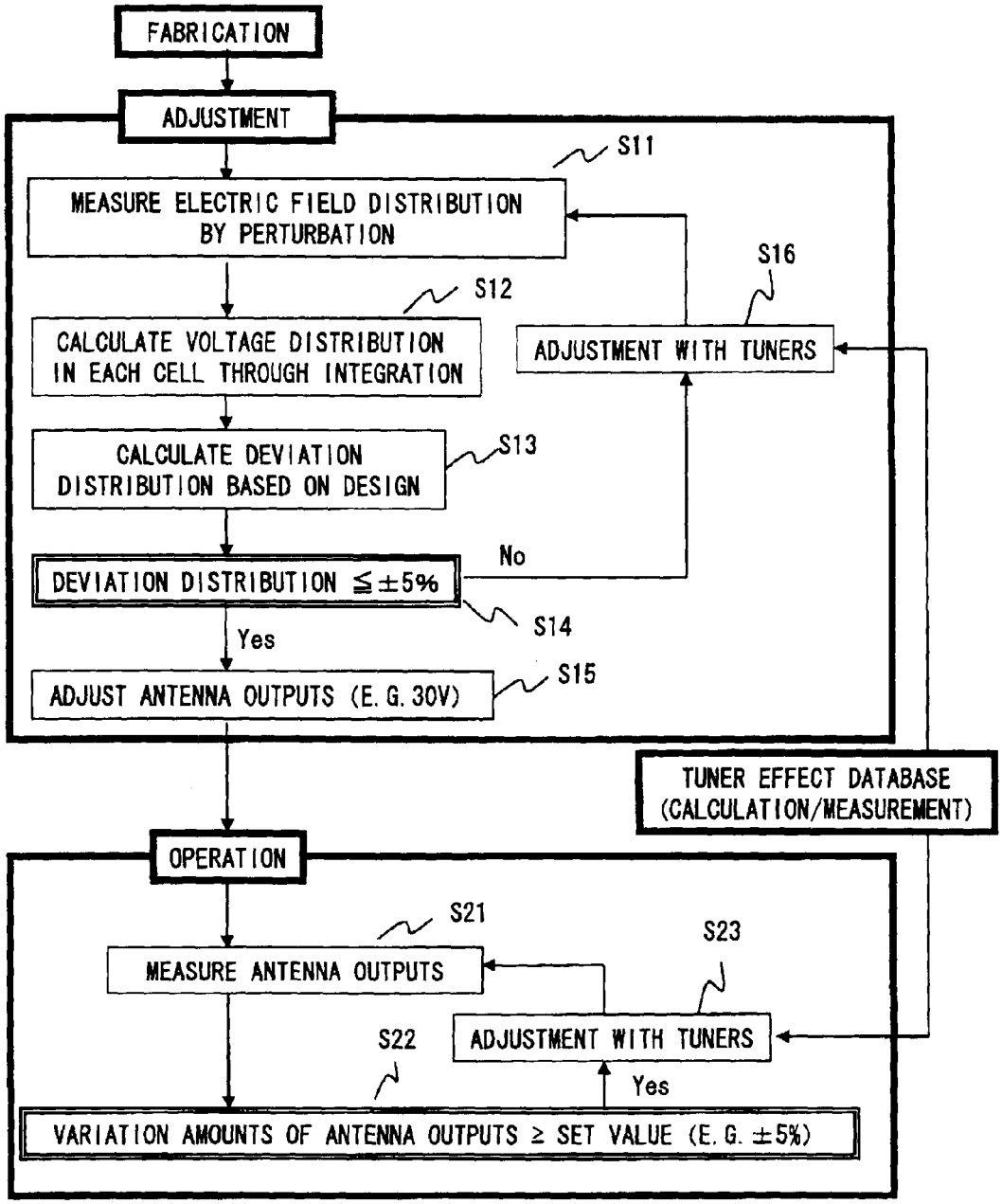
FIG. 12 is a flowchart indicating a process of adjusting the electric field distribution between the drift tube electrodes in the accelerator cavity.

FIG. 12 shows a flowchart indicating a process in which: the electric field distribution is adjusted just after fabrication of the above linac; and a variation of the electric field distribution owing to a thermal variation of the accelerator cavity is measured by the antenna 6 to automatically adjusting the electric field distribution when the linac is actually operated. Note that a character S in FIG. 12 denotes a processing step.

Here, in accordance with the flowchart in FIG. 12, an outline of the process of adjusting the electric field distribution will be described again. Just after fabrication of the linac, it is necessary to adjust the electric field distribution based on the drift tube electrodes 2 to be uniform. Therefore, first, the electric field distribution is measured by the perturbation method (for example, FIG. 3) (S11), and the electric field intensity at each cell is integrated to calculate the voltage distribution (for example, FIG. 4) (S12). Thereafter, the deviation distribution based on the design value is calculated for the cells (for example, FIG. 5) (S13). Then, it is confirmed whether or not the deviation distribution is within a range (for example, ±5%) of specification values (S14).

Then, if the deviation distribution for the cells is within a range of specification values, it is considered that the electric field distribution has been already adjusted to be uniform by the tuners 5. Therefore, the area of the loop section 61 is adjusted such that all the outputs of the antennas 6 are a predetermined value (for example, 30V) (S15).

On the other hand, if, in step S14, the deviation distribution is not within a range (for example, ±5%) of specification values, it is considered that the electric field distribution is yet to be adjusted to be uniform. Therefore, the insertion amounts of the tuners 5 are adjusted such that the deviation distribution represented by the aforementioned expression (6) tuned within a range of specification values by changing the insertion amounts (S16). At this time, the insertion amounts of the tuners 5 may be adjusted with reference to information about the tuner effect which is registered in advance in a database. Then, processing in steps S11 to S14 is repeated.

After the electric field distribution is adjusted after fabrication of the linac, the linac is actually operated. At this time, in order to confirm whether or not the electric field distribution has varied owing to a thermal variation of the accelerator cavity 1 caused by high power being fed, first, the outputs of the antennas are measured (S21). Then, it is determined whether or not variation amounts of the outputs of the antennas are equal to or larger than a set value (for example, ±5%) (S22).

At this time, if variation amounts of the outputs of the antennas are equal to or larger than a set value (for example, ±5%), it is considered that the electric field distribution has varied owing to the thermal variation. In this case, the insertion amounts of the tuners 5 are adjusted such that the deviation distribution represented by the aforementioned expression (6) tuned within a range of specification values by changing the insertion amounts (S23). At this time, the insertion amounts of the tuners 5 are adjusted with reference to information about the tuner effect which is registered in advance in a database. Thus, it becomes possible to, during actual operation of the linac, determine whether or not the electric field distribution is normal with the accelerator cavity kept vacuum, and to automatically perform feedback control for adjusting the electric field distribution by using a database registering the tuner effect.

Second Embodiment

Figure 13:
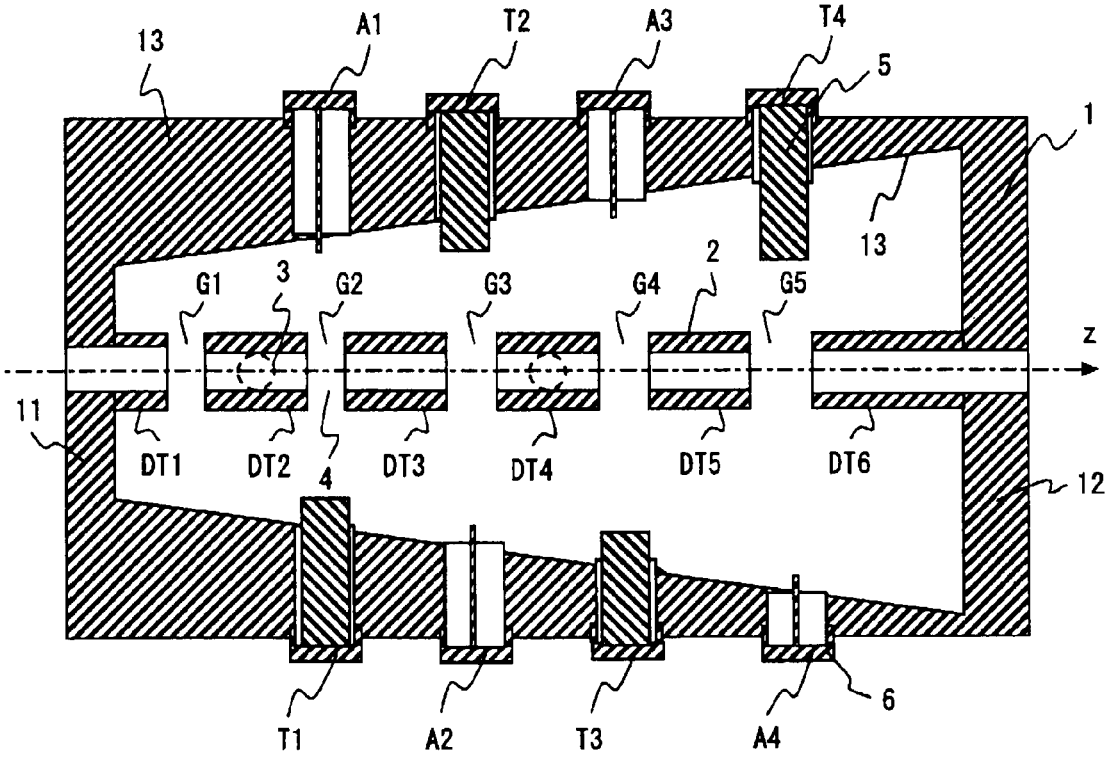
FIG. 13 is a cross-sectional view along the charged particle transporting direction (Z-axis direction) of an H-mode drift tube linac of a second embodiment of the present invention.

FIG. 13 is a cross-sectional view along the charged particle transporting direction (Z-axis direction) of the linac of a second embodiment. Components which correspond to or are the same as those of the first embodiment shown in FIG. 1 are denoted by the same reference numerals.

In the linac of the second embodiment, the tuners 5 alternately provided at the upside and the downside of the trunk section 13 so as to be directed: toward the substantial middles of the second to fifth gaps 4 (G2 to G5) along the Z-axis direction; and in the directions which are turned by 90 degrees from the directions of the stems 3 supporting the drift tube electrodes 2 and which are perpendicular to the Z-axis direction. However, the second embodiment is different in the antennas 6 from the first embodiment. The antennas 6 (A1 to A4) as many as the tuners 5 are provided so as to correspond to the respective positions at which the tuners 5 are provided.

That is, in the second embodiment, the antennas 6 are as many as the tuners 5, and are alternately provided at the upside and the downside of the trunk section 13 such that the antennas 6 are directed, in the direction perpendicular to the Z-axis direction, toward the substantial middles of the second to fifth gaps 4 (G2 to G5) along the Z-axis direction, the antennas 6 facing the respective tuners 5. In addition, in this case, the antennas 6 are provided via the adjustment systems 62 for adjusting the attenuation factors such that the antennas 6 have a common antenna output (for example, 30V).

Note that a manner of providing the antennas 6 is not necessarily limited to the above-described manner in which the antennas 6 are provided so as to face the tuners 5 via the gaps 4. The antennas 6 may be directed in any directions as long as the directions are included in planes which are perpendicular to the Z-axis direction and which pass through the substantial middles of the second to fifth gaps 4 (G2 to G5)

along the Z-axis direction. In addition, the numbers of the tuners 5 and the antennas 6 are not limited to four as in the second embodiment.

The other configurations and the operation of the antennas 6 are the same as in the first embodiment, and therefore, the detailed description thereof is omitted.

Here, factors causing a variation of the electric field distribution during operation of the linac are (1); a thermal variation in the accelerator cavity 1, (2); a variation of the insertion amount of each tuner 5, and (3) a variation of the gap length owing to a variation of the position where the drift tube electrode 2 is provided. The linac of the second embodiment is capable of early observing a variation of the electric field distribution owing to, particularly, (2) a variation of the insertion amount of each tuner 5 in addition to (1), among the factors of (1) to (3).

By the insertion amounts of the tuners 5 being varied, the cavity cross-sectional area of the accelerator cavity 1 decreases, and thus the electric field in the corresponding region can be reduced. Therefore, in general, the linac is configured such that the insertion amounts of the tuners 5 into the accelerator cavity 1 can be varied at any time. In addition, after the electric field distribution being adjusted, the tuners 5 are locked by a lock system such that the insertion amounts are not varied. However, during operation of the linac, the insertion amounts of the tuners 5 might vary owing to the lock being loosened by a certain influence, and then the electric field distribution might vary.

Figure 14:
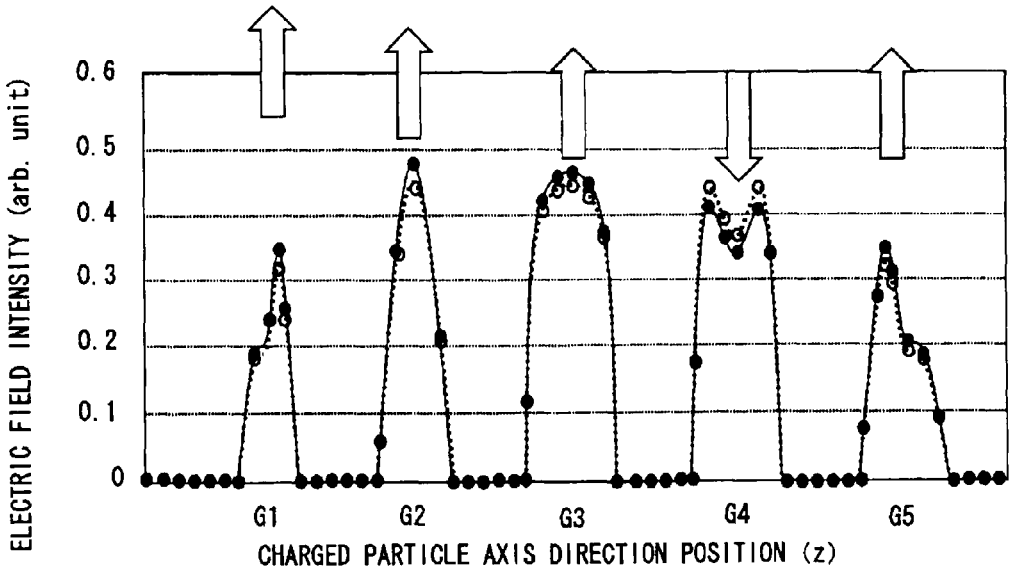
FIG. 14 shows an example of a result of measurement of the electric field intensity distribution by the perturbation method in the case where the insertion amount of a tuner varies.

FIG. 14 shows an example of a result of measurement of the electric field intensity distribution by the perturbation method in the case where the lock of the tuner 5 (here, tuner T3 present at the position corresponding to the gap G4) corresponding to the position of a given gap is loosened, thereby the tuner T3 being drawn into the accelerator cavity 1 and the insertion amount thereof increasing.

Note that in FIG. 4, a portion where the electric field distribution is zero corresponds to the position of each drift tube electrode 2, and a portion where the electric field is generated corresponds to the gap 4. However, since the electric field also penetrates into the drift tube electrode 2, a portion where a minute electric field is generated corresponds to an end portion of the drift tube electrode 2. In addition, as shown in FIG. 14, the electric field intensity decreases at the gap G4 corresponding to the tuner T3 having an increased insertion amount, whereas the electric field intensity increases at the other gaps.

Figure 15:
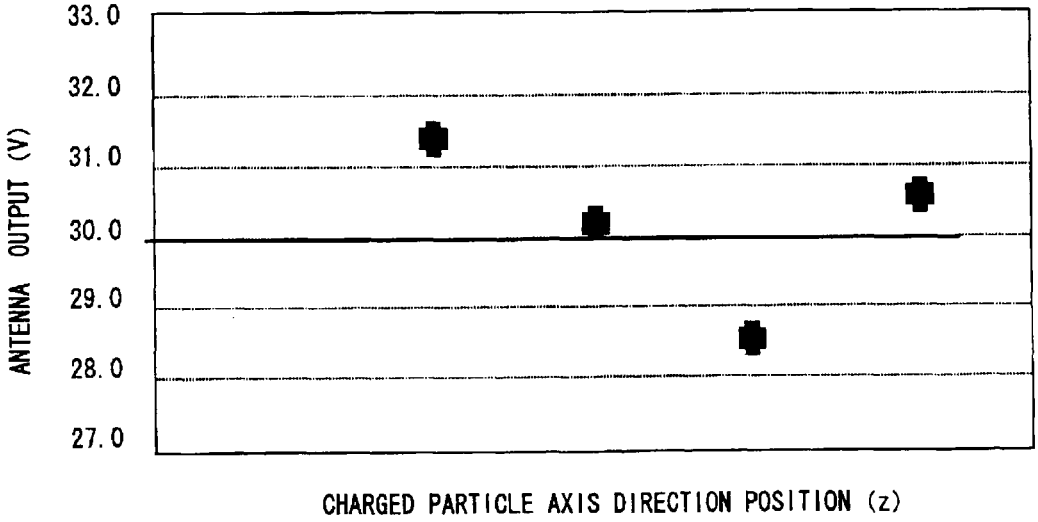
FIG. 15 is a diagram corresponding to FIG. 14, showing an antenna output distribution in the case where the insertion amount of the tuner varies.

FIG. 15 shows the values of the outputs of the antennas actually observed at this time. In this case, since the antennas 6 are provided at the respective positions corresponding to the tuners 5, the feature of a variation of the electric field distribution owing to a variation of the insertion amounts of the tuners 5 can be observed. Therefore, which tuners 5 have varied in their insertion amount and have caused a variation of the electric field distribution can be discovered early.

Moreover, in the case where, for example, the outputs of the antennas as shown in FIG. 15 are obtained, the linac which constantly ensures stable operation can be obtained by automatically performing feedback control for adjusting the insertion amount of each tuner 5 in accordance with a variation of the electric field distribution and for correcting the deviation from the design value. To achieve this, it is necessary to calculate or measure the tuner effect and obtain a database thereof. Since a method of obtaining the database is the same as in the first embodiment, the detailed description thereof is omitted.

In addition, in the case where variation amounts of the output signals of the antennas 6 are equal to or larger than a set value (±5%) as shown in FIG. 15, the insertion amounts of the tuners 5 are calculated based on the above database of the tuner effect such that the variation amounts of the output signals are smaller than the set value, and then feedback control is automatically performed.

Referring to FIG. 15, it is found that the insertion of the tuner 5 (T3) has caused the corresponding antenna output to vary by −5% from the original value and to be 28.5V. Therefore, since, referring to FIG. 11, a variation of a voltage at the position P4 caused when the tuner T3 is inserted by 20 mm from the reference position is about −5%, the tuner T3 needs to be extracted by 20 mm from the accelerator cavity 1.

Moreover, even when which tuner has varied in its amount is not figured out, it is not always necessary to return the insertion amounts of the tuners to the originally adjusted insertion amounts. Instead, the tuners may be adjusted again, in accordance with the expression (6), based on the database, such that the electric field distribution tuned within a range of ±5%.

Figure 16:
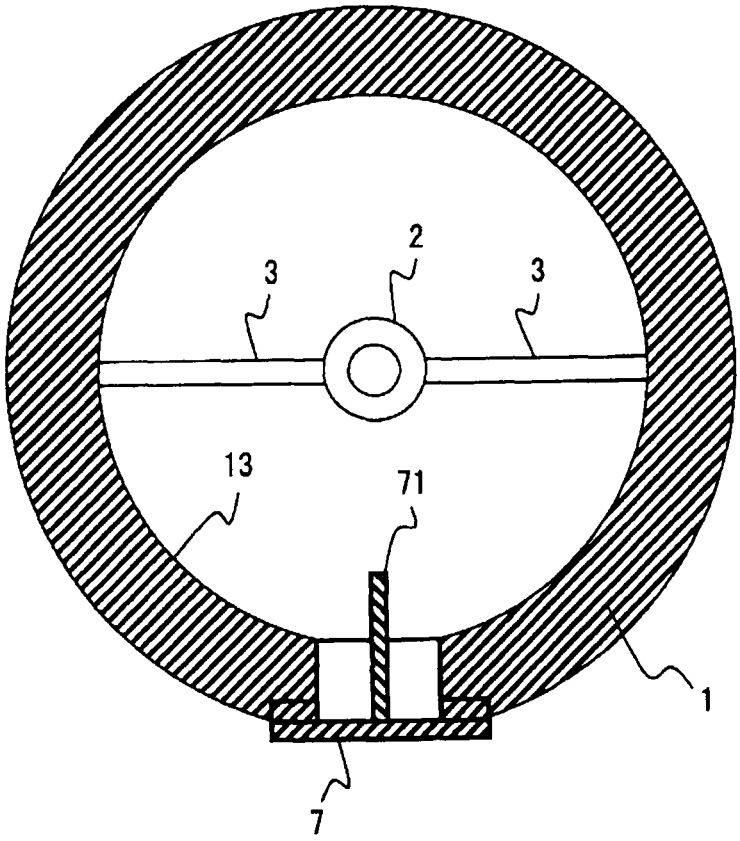
FIG. 16 is a cross-sectional view of the H-mode drift tube linac using a C-type antenna for measurement of a variation of the electric field distribution.

Note that although an L-type (inductance-type) loop antenna is used as the antenna 6 in the first and second embodiments, the shape of the antenna 6 is not limited thereto. For example, a C-type (capacitance-type) antenna 7 shown in FIG. 16 may be adopted.

That is, an antenna section 71 of the C-type antenna 7 is a simple rod-shaped antenna instead of a loop antenna. An electrostatic capacitance is generated between a tip of the rod-shaped antenna section 71 and an internal object in the accelerator cavity 1. A voltage is generated by electric charge being accumulated owing to the electrostatic capacitance, and then the voltage is measured. Even when the above-described C-type antenna 7 is used, whether or not the electric field distribution has varied can be measured while the inside of the accelerator cavity 1 is kept vacuum, and the structure of the antenna itself can be simplified.

Moreover, the present invention is not limited to the above-described L-type loop antenna or C-type antenna 7. The structure of the antenna is not limited to a particular structure as long as the antenna can extract the electromagnetic field intensity in the accelerator cavity 1.

Various modifications and alterations of this invention will be apparent to those skilled in the art without departing from the scope and spirit of this invention, and it should be understood that this is not limited to illustrative embodiments set forth herein.

What is claimed is:

1. An H-mode drift tube linac comprising:

an accelerator cavity which functions as a vacuum chamber and a resonator;

drift tube electrodes for generating accelerating voltages in a charged particle transporting direction in the accelerator cavity;

tuners for adjusting a distribution of electric fields generated at gaps between respective pairs of the drift tube electrodes; and antennas for measuring a variation of the distribution of the electric fields, the antennas being provided at least three positions which are a middle and both ends, along the charged particle transporting direction, of the accelerator cavity.

2. An H-mode drift tube linac comprising:

an accelerator cavity which functions as a vacuum chamber and a resonator;

drift tube electrodes in the accelerator cavity, for generating accelerating voltages in a charged particle transporting direction in the accelerator cavity;

tuners for adjusting a distribution of electric fields generated at gaps between respective pairs of the drift tube electrodes; and antennas for measuring a variation of the distribution of the electric fields, the number of the antennas being the same as that of the tuners, the antennas being provided along the charged particle transporting direction so as to correspond to respective positions at which the tuners are provided.

3. The H-mode drift tube linac according to claim 1, wherein the antennas are L-type loop antennas.

4. The H-mode drift tube linac according to claim 2, wherein the antennas are L-type loop antennas.

5. The H-mode drift tube linac according to claim 1, wherein the antennas are C-type antennas.

6. The H-mode drift tube linac according to claim 2, wherein the antennas are C-type antennas.

7. A method of adjusting a distribution of electric fields generated in an accelerator cavity in an H-mode drift tube linac, the H-mode drift tube linac including: the accelerator cavity which functions as a vacuum chamber and a resonator; drift tube electrodes for generating accelerating voltages in a charged particle transporting direction in the accelerator cavity; tuners for adjusting the distribution of the electric fields generated at gaps between respective pairs of the drift tube electrodes; and antennas for measuring a variation of the distribution of the electric fields, the antennas being provided at least three positions which are a middle and both ends, along the charged particle transporting direction, of the accelerator cavity, the method comprising:

a first step of: measuring the distribution of the electric fields, based on a perturbation method, when the H-mode drift tube linac is fabricated; and adjusting in advance the distribution of the electric fields by using the tuners, based on a result of the measurement such that, after the adjustment of the distribution of the electric fields, all outputs of the antennas tuned within a predetermined range;

a second step of, after the first step, measuring outputs of the antennas during operation in which the inside of the accelerator cavity is vacuumized and the accelerating voltages are generated between respective pairs of the drift tube electrodes; and a third step of, when variation amounts of the measured values of the outputs of the antennas are equal to or larger than a set value, adjusting the tuners by varying insertion amounts of the tuners such that the variation amounts are smaller than the set value.

8. A method of adjusting a distribution of electric fields generated in an accelerator cavity in an H-mode drift tube linac, the H-mode drift tube linac including: the accelerator cavity which functions as a vacuum chamber and a resonator; drift tube electrodes for generating accelerating voltages in a charged particle transporting direction in the accelerator cavity; tuners for adjusting the distribution of the electric fields generated at gaps between respective pairs of the drift tube electrodes; and antennas for measuring a variation of the distribution of the electric fields, the number of the antennas being the same as that of the tuners, the antennas being provided along the charged particle transporting direction so as to correspond to respective positions at which the tuners are provided, the method comprising:

a first step of: measuring the distribution of the electric fields, based on a perturbation method, when the H-mode drift tube linac is fabricated; and adjusting in advance the distribution of the electric fields by using the tuners, based on a result of the measurement such that, after the adjustment of the distribution of the electric fields, all outputs of the antennas tuned within a predetermined range;

a second step of, after the first step, measuring outputs of the antennas during operation in which the inside of the accelerator cavity is vacuumized and the accelerating voltages are generated between respective pairs of the drift tube electrodes; and a third step of, when variation amounts of the measured values of the outputs of the antennas are equal to or larger than a set value, adjusting the tuners by varying insertion amounts of the tuners such that the variation amounts are smaller than the set value.

9. The method according to claim 7, wherein relationships between: insertion amounts of the antennas into the accelerator cavity; and variations of voltages between respective pairs of the drift tube electrodes, are stored in advance as a database of a tuner effect, and in at least one of the first and third steps, when the distribution of the electric fields is adjusted by using the tuners, feedback control is automatically performed such that, based on the database, the insertion amounts of the tuners are varied to cause the distribution of the electric fields in the accelerator cavity to be uniform.

10. The method according to claim 8, wherein relationships between: insertion amounts of the antennas into the accelerator cavity; and variations of voltages between respective pairs of the drift tube electrodes, are stored in advance as a database of a tuner effect, and in at least one of the first and third steps, when the distribution of the electric fields is adjusted by using the tuners, feedback control is automatically performed such that, based on the database, the insertion amounts of the tuners are varied to cause the distribution of the electric fields in the accelerator cavity to be uniform.

* * * * *